United States Patent [19]

Oppenlaender et al.

[11] 4,207,285

[45] Jun. 10, 1980

[54] ALKANOLAMINE SALTS OF MALEAMIC ACIDS AS ANTI-CORROSION AGENTS IN AQUEOUS SYSTEMS

[75] Inventors: Knut Oppenlaender, Ludwigshafen; Wolfgang Kindscher, Fussgoenheim; Elmar Getto, Mannheim, all of Fed. Rep. of Germany

[73] Assignee: BASF Aktiengesellschaft, Fed. Rep. of Germany

[21] Appl. No.: 971,234

[22] Filed: Dec. 20, 1978

[30] Foreign Application Priority Data

Dec. 24, 1977 [DE] Fed. Rep. of Germany ..... 2758123

[51] Int. Cl.[2] ..... C23F 11/14

[52] U.S. Cl. ..... 422/16; 252/392; 422/17

[58] Field of Search ..... 422/16, 17, 12, 13; 252/392

[56] References Cited

U.S. PATENT DOCUMENTS

| | | | |
|---|---|---|---|
| 2,742,498 | 4/1956 | Smith et al. | 252/392 X |
| 2,944,969 | 7/1960 | Stromberg et al. | 252/392 X |
| 2,977,309 | 3/1961 | Godfrey et al. | 252/392 X |
| 3,121,057 | 2/1964 | Gee et al. | 252/392 X |
| 3,251,776 | 5/1966 | Gee et al. | 252/392 X |
| 3,654,346 | 4/1972 | Godar et al. | 422/16 X |
| 3,762,873 | 10/1973 | Oude Alink | 422/16 X |
| 3,773,479 | 11/1973 | Dorn et al. | 252/392 X |
| 4,053,426 | 10/1977 | Davis et al. | 252/392 X |

FOREIGN PATENT DOCUMENTS

| | | | |
|---|---|---|---|
| 569600 | 1/1959 | Canada | 422/17 |
| 1149843 | 6/1963 | Fed. Rep. of Germany | 422/7 |

*Primary Examiner*—Barry S. Richman

*Attorney, Agent, or Firm*—Keil & Witherspoon

[57] ABSTRACT

A process for preventing the corrosion of metals in aqueous systems by means of low-foam corrosion inhibitors consisting of alkanolamine salts of maleamic acids.

4 Claims, No Drawings

ALKANOLAMINE SALTS OF MALEAMIC ACIDS AS ANTI-CORROSION AGENTS IN AQUEOUS SYSTEMS

The present invention relates to a novel method for preventing corrosion, using alkanolamine salts of maleamic acids as low-foam corrosion inhibitors in aqueous systems.

Industrial purification and cooling processes carried out in the presence of water always present the problem of corrosion protection if metals prone to corrosion, particularly iron and iron-containing alloys, come into direct contact with these processes (for example where aqueous industrial cleaning agents, cooling water, or cooling lubricants for metalworking are involved).

A further problem which arises with such processes, above all where cooling waters and cooling lubricants are involved, is excessive foaming, especially if organic anti-corrosion agents, which frequently exhibit surfactant properties, are added to the water. Hitherto, it has therefore been necessary, in most cases, to add an anti-foam agent together with the organic anti-corrosion agent.

It is an object of the present invention to provide additives, for the above aqueous systems, which 1. are water-soluble,
2. possess a good anti-corrosion effect,
3. show very little tendency to foam and
4. show very little sensitivity to water hardness.

German Published Application DAS No. 1,149,843 discloses amine salts of amidoacids, obtained by reacting succinic anhydride or maleic anhydride with primary alkylamines, where alkyl is of 4 to 30 carbon atoms, and then neutralizing the product with such amines, as lubricant additives and fuel additives having an anti-rust effect. The agents mentioned by way of example in the said publication are, however, oil-soluble and in most cases not water-soluble. Where they are water-soluble, it has been found that they either foam much too heavily in the above systems (it may be noted that the above publication also refers to the addition of anti-foam agents) or, if they foam less, that they lose a substantial part of their anti-corrosion effect.

It is true that it was obvious, in the case of aqueous systems, to carry out the neutralization not with the amines mentioned in German Published Application DAS No. 1,149,843, but with the alkanolamines conventionally used for such purposes. However, it was found that depending on the chain length of the radical R in the formula shown in claim 1, either—if R was a long chain—very heavily foaming products, which are virtually water-insoluble, were formed, whilst—if R was a short chain—the anti-corrosion effect was lost.

In addition, the chain length also influences the solubility in water, and the degree of sensitivity to water hardness.

We have found, surprisingly, that the object of the invention is achieved if the chain length of R lies within a particular very narrow range and if R is a certain type of isomer.

The object of the invention is achieved with particular salts of maleamic acids of the formula $$R\text{-}NHCO\text{-}CH{=}CHCOOH \qquad I$$

where R is an isoalkyl radical in which the longest chain is of 6 to 8 carbon atoms, whilst the entire radical is of 8 to 12 carbon atoms.

Preferably, these salts are present in the above systems in an amount of from 0.1 to 3% by weight, based on water.

The salts are obtained by neutralizing the mono-isooctylamide, -isononylamide, -isodecylamide, -isoundecylamide and/or -isododecylamide of maleic acid with mono-, di- or tri-$C_2$— to —$C_3$-alkanolamines or mixtures of such alkanolamines.

These salts differ from those of German Published Application DAS No. 1,149,843 not only in that the alkanolamines are used to form the salts, but also in that certain specific amidoacid components, not explicitly disclosed in the said DAS, are employed. It is true that the said publication mentions the starting materials for the manufacture of these amidoacids, but it does not mention the end products.

We have found that even using n-$C_8$-alkylamines or lower alkylamines, such as n-$C_7$-alkylamines, or using $C_7$-isoalkylamines as starting materials results in a great weakening of the anti-corrosion effect of the end product, whilst if isoalkylamines in which the longest chain is of more than 8 carbon atoms are used as starting materials, end products which foam too heavily are formed. End products obtained with isoalkylamines of more than 7 carbon atoms as the starting material exhibit little sensitivity to water hardness. From about 12 carbon atoms upward the sensitivity of the end products to water hardness increases very greatly, and the solubility in water diminishes greatly.

The starting materials used to prepare the maleamic acids are maleic anhydride and primary isoalkylamines of 8 to 12 carbon atoms, with a longest chain of 6 to 8 carbon atoms, eg. isooctylamines, isononylamines, isodecylamines, isoundecylamines and isododecylamines, of which the first two are preferred. These amines can also be employed as mixtures with a proportion of the corresponding n-alkylamines. Such mixtures are obtained, for example, from a hydroformylation reaction.

The reaction of the maleic anhydride with the amine or amine mixture can be carried out in accordance with conventional methods. The amidoacids obtained are then neutralized with one of the alkanolamines defined above, or with mixtures of these, in the conventional manner. Preferably, an excess of alkanolamine is used.

For the purposes of the invention, particularly suitable alkanolamines are, for example, diethanolamine, triethanolamine, diisopropanolamine and triisopropanolamine, and mixtures of these.

The most effective products have proved to be the mono-2-ethylhexylamide and mono-isononylamide of maleic acid, neutralized with triethanolamine and diethanolamine.

The results, according to the invention, are achieved not only with the monoamides alone but also if these are mixed with up to 90% by weight of compounds of the formula shown, where R is n-alkyl of 8 to 12 carbon atoms. Such compounds include, in particular, the mono-n-octylamide, -nonylamide, -decylamide and -dodecylamide.

General Manufacturing Instructions

Maleic anhydride is melted at 60°-70° C. under a $N_2$ atmosphere, the appropriate amine is then added in the molar ratio of 1:1 at 60°–100° C., whilst stirring, and stirring is then continued for from half to one hour.

To neutralize the maleamic acids formed, they are mixed with the appropriate alkanolamine in the molar ratio of from 1:1 to 1:4 and the mixture is stirred until a clear liquid results.

EXAMPLE 1

147 g (1.5 moles) of maleic anhydride are melted at 60°–70° C. under a $N_2$ atmosphere, 193.5 g (1.5 moles) of 2-ethylhexylamine are then added slowly at 60°–80° C., whilst stirring, and stirring is then continued for half an hour at 80° C.

A crystalline substance having a melting point of 69° C. and an acid number of 252 (theoretical value 247) is obtained.

30 parts by weight of this maleamic acid are then mixed with 70 parts by weight of triethanolamine containing a proportion of diethanolamine and the mixture is stirred, without additional heating, until a clear liquid results.

EXAMPLE 2

147 g (1.5 moles) of maleic anhydride are melted at 60°–70° C. under a $N_2$ atmosphere, 213 g (1.5 moles) of an isononylamine are then added slowly at 60°–100° C., whilst stirring, and stirring is then continued at the same temperature for from half to one hour.

A crystalline substance having a melting point of 62° C. and an acid number of 235 (theoretical value 233) is obtained.

30 parts by weight of the resulting maleamic acid are then mixed with 70 parts by weight of triethanolamine (as in Example 1), without additional heating, and the mixture is stirred until a clear liquid results.

EXAMPLE 3

147 g (1.5 moles) of maleic anhydride are melted at 60°–70° C. under a $N_2$ atmosphere, 273 g (1.5 moles) of isododecylamine (longest chain: 6 carbon atoms) are then added slowly at 60°–80° C., whilst stirring, and stirring is then continued for one hour at 80° C.

A liquid having an acid number of 191 (theoretical value 191) is obtained.

30 parts by weight of the resulting maleamic acid are then mixed with 70 parts by weight of triethanolamine (as in Example 1), without additional heating, and the mixture is stirred until a liquid exhibiting a slight, homogeneously distributed turbidity has formed.

Performance tests of the products according to the invention and of comparative materials In addition to the three products according to the invention, mentioned in the Examples, a number of other maleamic acids and one succinamic acid are included for comparison purpose in the Table to show the extremely narrow range within which the various performance characteristics which form the object of the invention are displayed simultaneously.

The anti-corrosion effect was determined by the "Herbert" corrosion test and by the "grey cast iron" filter test. The anti-foam effect was determined by the "IG foam-beating method", based on DIN 53,902.

The corrosion tests were carried out as follows:

(a) Herbert corrosion test

The anti-corrosion effect is demonstrated by means of the Herbert test system which has become accepted in the metalworking sector; a 1% strength aqueous solution of the active substance is used, the water hardness being 10° German hardness. The test employs a standardized grey cast iron plate, and 5 mm long standardized steel filings supplied by Messrs. Alfred Herbert, Coventry, England. The square plate, of size 100×100×5 mm, is carefully ground, before the test, by means of a belt grinder using a corundum belt, grain size 120, and is then washed with white spirit and ethanol and dried with a clean cloth. The steel filings supplied with the test system and consisting of filings obtained from 0.40% carbon steel under standardized conditions, are then placed, by means of a suitable metal or plastic spoon having the capacity of a normal teaspoon, in four small heaps on the cast iron plate prepared as above, with the heaps being the same distance from one another and from the edges of the plate. The filings should constitute a single layer packed as closely as possible.

The solutions or emulsions to be tested for their corrosion characteristics are applied to the small heaps of filings, by means of a measuring pipette, in such amount that the filings just manage to keep the liquid which reaches the cast iron plate from spreading. After leaving the system for 24 hours at 70% relative atmospheric humidity, the filings are shaken off the plate by tipping the latter. The clearly visible outline of the dried-on aqueous medium remains on the plate. At the points of contact of the filings with the plate, rust marks of greater or lesser extent have formed, depending on the corrosiveness of the liquid, and may even have merged into a continuous layer of rust. The assessment is made visually by estimating the percentage of the surface which shows rust.

(b) Grey cast iron filter test

This is a further corrosion test. A Petri dish of about 10 cm internal diameter, with a suitable cover dish, is used. A black-band filter disk is placed in the Petri dish. 5–10 g of coarse GG-20 grey cast iron filings are distributed on the filter by means of a suitable spoon so as to form a uniform heap in the center, leaving a ring about 1.5 cm wide clear all round the periphery. The filings are from about 5 to 8 mm long and must be produced from clean GG-20 grey cast iron material without using drilling oil or other cooling lubricants. All fine constituents must be screened out.

5 ml portions of the solution or emulsion to be tested for its corrosiveness are in each case applied uniformly to the filings by means of a measuring pipette. The pH of the test liquid is recorded, since it is of substantial importance in the assessment. The pH can alternatively be brought to a particular standard value, for example 8.5. After moistening the filings, the cover dish is placed in position and the sample is left to stand for 2 hours under normal laboratory conditions of 23°–25° C. and about 70% relative atmospheric humidity. The cover is then removed and the filter briefly inverted and floated on tapwater, so as to remove the filings. Immediately thereafter, the filter paper thus freed from filings is sprayed, and thereby impregnated, with an indicator solution comprising 1 g of potassium ferricyanide and 30 g of sodium chloride in 1 liter of water. The indicator is then allowed to act for 17 seconds in air. Finally, the filter is carefully rinsed in running tapwater and dried in air, in a moderately warm place. After this procedure, brownish yellow, yellow and/or bluish green spots of varying intensity form on the filter paper, depending on the corrosiveness of the medium, the brownish yellow or yellow color being assessed as the more adverse result. Satisfactory behavior is indicated by the absence of any brown or yellow coloration, with at most traces of pale bluish green spots present. The color of the filter is completely stable and the latter can therefore be used for documentation. An assessment scale might run as follows:

Very poor (− −): intense, large, predominantly yellowish brown spots.

Poor (−): intense, large spots, yellowish brown and bluish green to about equal extent.

Medium (+ −): faded medium-size spots with yellow and bluish green to about equal extent.

Good (+): very faded, small (pinhead size) spots, with bluish green predominating.

Very good (+ +): no spots, or at most very few, very small, pale bluish green spots.

(c) Foaming

The beating method based on DIN 53,902 was used. To carry out the test, the simple procedure, in which the ram carrying the perforated plate is moved evenly up and down manually 30 times in 30 seconds and is then carefully withdrawn (IG beating method), suffices. The foam volume is read off on the graduated foam cylinder, in ml, after 1, 5 and 10 minutes. It is important to specify the temperature, concentration and water hardness.

TABLE

| Sample (salt) | Concentration of salt in % → | Herbert test (% of surface covered with rust) 1.25% | Distilled water: Grey cast iron test 1.25% | Distilled water: Foam volume (2 g/l, beating method, room temperature, volume in ml) after 1 minute | after 5 minutes | after 10 minutes | Drinking water, 10° German hardness: Herbert test (% of surface covered with rust) 1.25% | Drinking water, 10° German hardness: Grey cast iron test 1.25% |
|---|---|---|---|---|---|---|---|---|
| Example 1: Maleic acid 2-ethylhexylamide (30 parts by weight) + 70 parts by weight of triethanolamine | | 0 | ++ | 10 | 0 | 0 | 0 | ++ |
| Example 2: Maleic acid isononylamide (30 parts by weight) + 70 parts by weight of triethanolamine | | 0 | ++ | 100 | 60 | 40 | 0 | ++ |
| Example 3: Maleic acid isododecylamide (30 parts by weight) + 70 parts by weight of triethanolamine | | 0 | ++ | 20 | 20 | 20 | 0 | ++ |
| Comparison: Succinic acid 2-ethylhexylamide (40 parts by weight) + 60 parts by weight of triethanolamine | | 0 | ++ | 10 | 0 | 0 | 0 | ++ |
| Comparison: Maleic acid di-isobutylamide (30 parts by weight) + 70 parts by weight of triethanolamine | | 70 | +− | 20 | 15 | 15 | 80 | +− |
| Comparison: Maleic acid heptylamide (30 parts by weight) + 70 parts by weight of triethanolamine | | 15 | +− | 30 | 15 | 10 | 60 | +− to − |
| Comparison: Maleic acid n-octylamide (30 parts by weight) + 70 parts by weight of triethanolamine | | 1 | +− to − | 30 | 20 | 20 | 2 | +− to − |
| Comparison: Maleic acid iso-octylamide (less than 6 C in the longest chain) (30 parts by weight) + 70 parts by weight of triethanolamine | | 20 | +− to − | 10 | 10 | 1 | 20 | +− to − |
| Comparison: Maleic acid n-dodecylamide (35 parts by weight) + 65 parts by weight of triethanolamine | | 30 | + | 430 | 360 | 340 | 30 | + |
| Comparison: Maleic acid iso-tridecylamide (40 parts by weight) + 60 parts by weight of triethanolamine | | 5 | ++ to + | 900 | 720 | 370 | 5 | + |
| Example 4: Maleic acid $C_9/C_{11}$-n/iso-(50:50)-amide (35 parts by weight) + 65 parts of triethanolamine | | 0 | ++ | 40 | 30 | 20 | <1 | ++ |

| Sample (salt) | Concentration of salt in % → | Water artificially brought to 20° German hardness: 2% | 3% | 2% | 3% | pH of a 20% strength solution in water of 20° German hardness | Solubility, external appearance of the solution: 1.25% strength in distilled water | 3% strength in water of 20° German hardness | External appearance of the salt |
|---|---|---|---|---|---|---|---|---|---|
| Example 1: Maleic acid 2-ethylhexylamide (30 parts by weight) + 70 parts by weight of triethanolamine | | 0 | 5 | ++ | ++ | 8.5 | almost clear | transparent | clear, fluid |
| Example 2: Maleic acid isononylamide (30 parts by weight) + 70 parts by weight of triethanolamine | | 0 | 0 | ++ | ++ | 8.6 | clear | almost clear | clear, fluid |
| Example 3: Maleic acid isododecylamide (30 parts by weight) + 70 | | | | | | | | | slightly |

TABLE-continued

| | | | | | | | | |
|---|---|---|---|---|---|---|---|---|
| parts by weight of triethanolamine | 5 | 5 | ++ to + | ++ | 8.5 | transparent | cloudy | cloudy, fluid |
| Comparison: Succinic acid 2-ethyl-hexylamide (40 parts by weight) + 60 parts by weight of triethanolamine | 0 | 0 | ++ to + | ++ | 8.5 | undissolved | undissolved | clear, fluid |
| Comparison: Maleic acid di-isobutyl-amide (30 parts by weight) + 70 parts by weight of triethanolamine | 50 | 30 | + to +− | + to +− | 8.6 | clear | clear | clear, fluid |
| Comparison: Maleic acid heptylamide (30 parts by weight) + 70 parts by weight of triethanolamine | 80 | 20 | +− to − | +− to − | 8.5 | clear | clear | clear, fluid |
| Comparison: Maleic acid n-octyl-amide (30 parts by weight) + 70 parts by weight of triethanolamine | 5 | 0 | +− to − | +− to − | 8.6 | clear | clear to transparent | clear, fluid |
| Comparison: Maleic acid iso-octyl-amide (less than 6 C in the longest chain) (30 parts by weight) + 70 parts by weight of triethanolamine | 30 | 10 | +− to − | ++ to + | 8.3 | transparent, precipitation occurs | transparent, precipitation occurs | slightly cloudy, fluid |
| Comparison: Maleic acid n-dodecyl-amide (35 parts by weight) + 65 parts by weight of triethanolamine | 50 | 30 | + | ++ | 8.5 | clear to transparent | transparent to cloudy | slightly cloudy, fluid |
| Comparison: Maleic acid iso-tridecyl-amide (40 parts by weight) + 60 parts by weight of triethanolamine | 5 | 1 | ++ to + | ++ to + | 8.4 | clear | almost clear | clear, fluid |
| Example 4: Maleic acid $C_9/C_{11}$-n/iso-(50:50)-amide (35 parts by weight) + 65 parts of triethanolamine | 5 | 0 | ++ | ++ | | almost clear | transparent | clear, fluid |

We claim:

1. A method of preventing corrosion of metals in industrial processes taking place in the presence of water, wherein a mono-, di- or tri-$C_2$— to —$C_3$-alkanolamine salt of a maleamic acid of the formula I $$R\text{-}NHCO\text{-}CH{=}CHCOOH \qquad I$$

where R is an isoalkyl radical in which the longest chain is of 6 to 8 carbon atoms, whilst the entire radical is of 8 to 12 carbon atoms, is employed as a low-foam corrosion inhibitor.

2. A method as claimed in claim 1, wherein from 0.1 to 3% by weight, based on water, of the corrosion inhibitor is employed.

3. A method as claimed in claim 1, wherein a salt of a maleamic acid of the formula I, where R is isooctyl or isononyl, is employed.

4. A method as claimed in claim 1, wherein the salt used is mixed with up to 90% by weight, based on the mixture, of compounds of the same formula, where R is a n-alkyl radical of 8 to 12 carbon atoms.

* * * * *